US008724840B2

(12) United States Patent
Doller et al.

(10) Patent No.: US 8,724,840 B2
(45) Date of Patent: May 13, 2014

(54) OFFSET ACOUSTIC CHANNEL FOR MICROPHONE SYSTEMS

(75) Inventors: Andrew J. Doller, Sharpsburg, PA (US); Michael J. Daley, Canonsburg, PA (US)

(73) Assignee: Robert Bosch GmbH, Stuttgart (DE)

( * ) Notice: Subject to any disclaimer, the term of this patent is extended or adjusted under 35 U.S.C. 154(b) by 54 days.

(21) Appl. No.: 13/427,550

(22) Filed: Mar. 22, 2012

(65) Prior Publication Data

US 2013/0251183 A1 Sep. 26, 2013

(51) Int. Cl.
*H04R 1/34* (2006.01)

(52) U.S. Cl.
USPC ..... 381/359; 381/355; 381/189

(58) Field of Classification Search
USPC ..... 381/189, 357, 359, 368, 338, 335, 351, 381/355, 322; 181/198, 199, 293
See application file for complete search history.

(56) References Cited

U.S. PATENT DOCUMENTS

| | | | | |
|---|---|---|---|---|
| 6,091,830 | A * | 7/2000 | Toki | 381/359 |
| 7,072,482 | B2 * | 7/2006 | Van Doorn et al. | 381/355 |
| 7,843,021 | B2 | 11/2010 | Zhe et al. | |
| 2008/0118096 | A1 * | 5/2008 | De Pooter et al. | 381/359 |
| 2008/0144863 | A1 * | 6/2008 | Fazzio et al. | 381/190 |
| 2008/0304681 | A1 | 12/2008 | Langlois et al. | |
| 2010/0080405 | A1 | 4/2010 | Wu et al. | |
| 2010/0128914 | A1 | 5/2010 | Khenkin | |
| 2010/0272302 | A1 | 10/2010 | Feiertag et al. | |
| 2011/0158453 | A1 | 6/2011 | Tanaka et al. | |
| 2012/0257777 | A1 * | 10/2012 | Tanaka et al. | 381/355 |
| 2012/0328142 | A1 * | 12/2012 | Horibe et al. | 381/355 |

FOREIGN PATENT DOCUMENTS

| | | |
|---|---|---|
| CN | 201042078 | 3/2008 |
| CN | 101646120 | 2/2010 |

OTHER PUBLICATIONS

Machine translation of CN 101646120 "Capacitance Microphone".
International Search Report and Written Opinion for Application No. PCT/US2013/033549 dated Jun. 6, 2013 (8 pages).

* cited by examiner

*Primary Examiner* — Curtis Kuntz
*Assistant Examiner* — Joshua A Kaufman
(74) *Attorney, Agent, or Firm* — Michael Best & Friedrich LLP

(57) ABSTRACT

A microphone with an offset acoustic channel. The microphone includes an external case, an acoustic chamber enclosure within the external case, a microphone transducer positioned within the acoustic chamber enclosure, and a gasket positioned between the external case and the acoustic chamber enclosure. A first opening in the external case is positioned an offset lateral distance from a second opening in the acoustic chamber enclosure. An acoustic channel is formed in the gasket extending from the first opening to the second opening along the offset lateral distance.

15 Claims, 7 Drawing Sheets

OFFSET ACOUSTIC CHANNEL FOR MICROPHONE SYSTEMS

BACKGROUND

The present invention relates to microphone systems such as those found in electronics such as, for example, cellular telephones. In particular, the present invention relates to systems and apparatuses for protecting microphones installed in such devices.

SUMMARY

With a combination of microphone gaskets, printed circuitry and/or housing modifications, embodiments of the invention use materials and processes to eliminate or reduce the effect of light on microphones incorporated in devices or systems. Embodiments of the invention also provide protection from wind and/or other environmental contaminants while simultaneously providing a known and measureable acoustic coupling from the outside of the device to the internal cavities of a microphone package.

In one embodiment, the invention provides a microphone with an offset acoustic channel. The microphone includes an external case, an acoustic chamber enclosure within the external case, a microphone transducer positioned within the acoustic chamber enclosure, and a gasket positioned between the external case and the acoustic chamber enclosure. A first opening in the external case is positioned an offset lateral distance from a second opening in the acoustic chamber enclosure. An acoustic channel is formed in the gasket extending from the first opening to the second opening along the offset lateral distance.

In some embodiments, the microphone also includes a substrate positioned between the gasket and the acoustic chamber enclosure. The acoustic chamber enclosure and one or more electronic devices are mounted on the substrate. The second opening from the acoustic chamber enclosure extends through the substrate to the acoustic channel.

In some embodiments, the acoustic channel is formed across the entire thickness of the gasket. In other embodiments, the acoustic channel is formed across only a portion of the thickness of the gasket. In some embodiments, the acoustic channel extends into at least one of the external case, a surface of the acoustic chamber enclosure, and the substrate.

In some embodiments, the external case of the microphone includes a first surface parallel to the gasket and a second surface substantially perpendicular to the first surface. In some embodiments, the first opening of the external case is located on the first surface while, in other embodiments, the first opening is located on the second surface.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Many commercial devices, such as, for example, cellular telephones, computers, and communication headsets, include microphone systems. Some of these microphone systems include microelectromechanical system (MEMS) microphone transducers. Examples of MEMS microphone transducers are described in further detail in U.S. Pat. No. 7,863,714, filed Jan. 4, 2011 and entitled "MONOLITHIC MEMS AND INTEGRATED CIRCUIT DEVICE HAVING A BARRIER AND METHOD OF FABRICATING THE SAME," and U.S. application Ser. No. 13/207,130, filed Aug. 10, 2011 and entitled "TRIM METHOD FOR CMOS-MEMS MICROPHONES," the entirety of both of which are incorporated herein by reference.

If the mechanical components of microphone transducers in such devices are exposed to light, wind, or particles, the performance of the microphone may be adversely affected. In some cases, such exposure can cause permanent damage to the microphone transducer. Light can affect ASIC circuitry due to the photo-electric effect of semiconductors, which, among other things, injects unwanted signals into traces and changes transduction coefficients of transistors. Excessive wind applied to the microphone diaphragm causes unwanted signal and can cause permanent deflection or other damage to the microphone diaphragm. Due to the micron-scale of MEMS microphone components, dust particles can clog holes in the device restricting proper air movement and can form a physical barrier between the membrane and the backplate of the microphone transducer. Furthermore, wind and other air pressure sources cause small particles to act as projectiles that can physically damage the membrane and other structures of the microphone transducer.

To prevent or limit damage to the microphone transducer caused by light, wind, or particles, various device configurations described below provide an offset acoustic channel through which sounds can reach the microphone transducer. However, the offset channel prevents any direct exposure of the microphone transducer to external elements.

Figure 1:
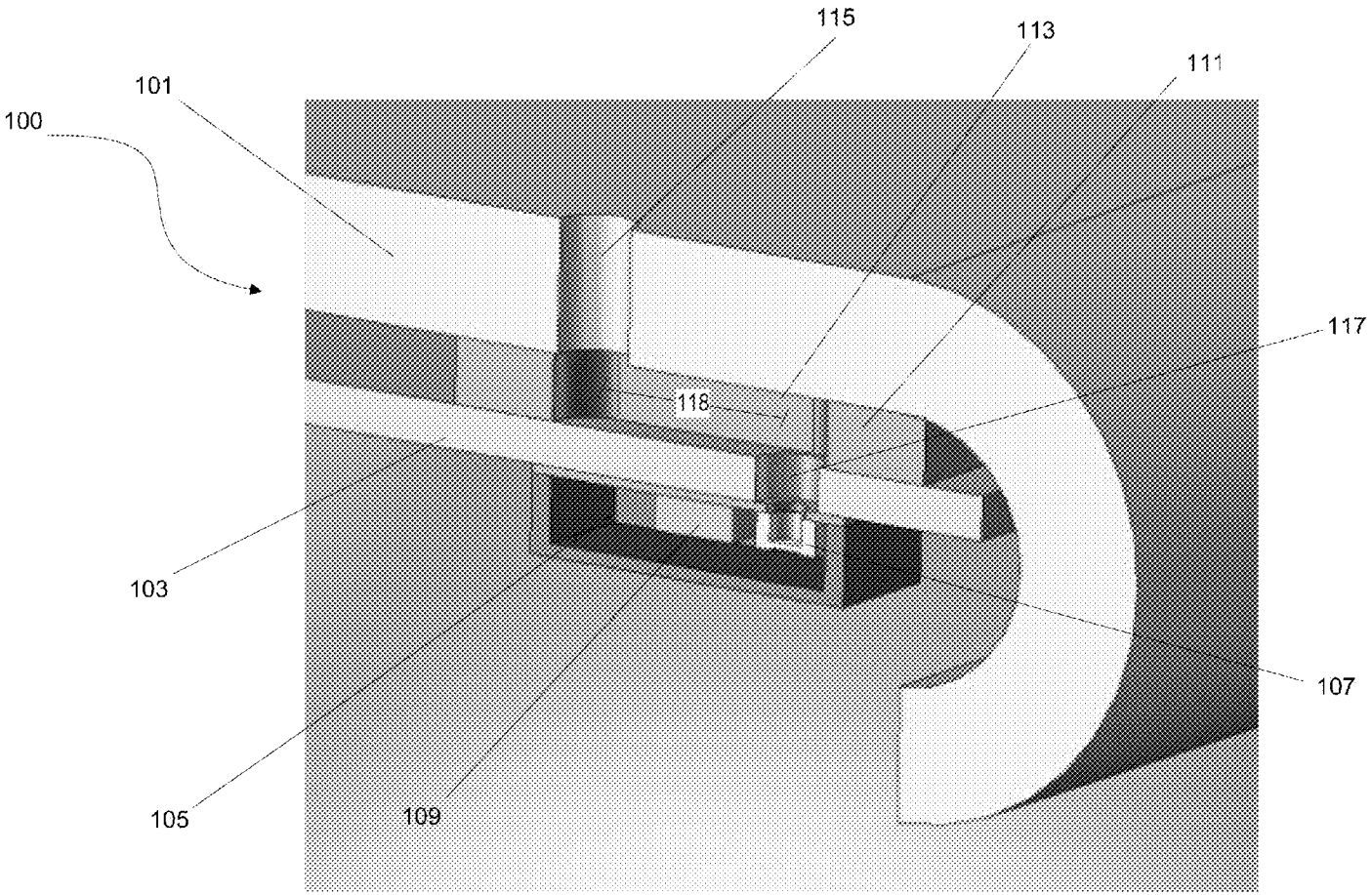
FIG. 1 is a cross-sectional perspective view of a microphone according to one embodiment, where a substrate is positioned between the gasket and the acoustic chamber enclosure, and the acoustic channel is formed in the gasket.

FIG. 1 illustrates one example of a microphone 100. The phrase microphone is used herein to refer to a stand-alone microphone or a portion of a device, such as, for example, a cellular telephone or a laptop computer, including a microphone transducer and associated housing components. The microphone 100 includes an offset channel to prevent direct exposure of the microphone transducer—the elements of a microphone that converts sound to an electric signal. The microphone 100 includes an external case 101 and a substrate 103. The external case 101 is formed of a plastic material. The substrate 103 includes a printed circuit board or other material for mounting electronic devices inside of the external case of 101 of the system. An acoustic chamber enclosure 105 is mounted on the surface of the substrate 103. The acoustic chamber enclosure 105 is a cuboid-shaped structure housing a microphone transducer 107 and an application-specific integrated circuit (ASIC) 109 that controls the operation of the microphone transducer 107 and processes signals from the microphone transducer 107. In some other constructions, the microphone transducer 107 is incorporated into the ASIC 109 to form a single MEMS-CMOS component. The acoustic chamber enclosure 105 is positioned on the substrate 103 such that the substrate 103 forms one of the surfaces of the acoustic chamber enclosure 105. In this way, the microphone transducer 107 and the ASIC 109 are mounted on the substrate 103 and inside the acoustic chamber enclosure 105.

A gasket 111 is positioned between the external case 101 and the substrate 103. The gasket 111 absorbs vibrations between the external case 101 and the substrate 103 while also providing a sealed acoustic channel 113 to the acoustic chamber enclosure 105. To form the offset acoustic channel from the exterior of the system to the microphone transducer 107, the external case includes a first opening 115. A second opening 117 is provided in the acoustic chamber enclosure 105 through the substrate 103. As illustrated in FIG. 1, the second opening 117 is positioned at an offset lateral distance 118 from the first opening 115. The acoustic channel 113 formed in the gasket 111 extends from the first opening 115 to the second opening 117 along the offset lateral distance. As such, neither the first opening 115 nor the second opening 117 provides a direct pathway from the exterior of the microphone 100 to the microphone transducer 107. In some other constructions, a screen or film (not pictured) is positioned within the acoustic pathway to provide an additional physical barrier to prevent small particles from reaching the acoustic chamber enclosure.

FIGS. 2-7 illustrate further examples of microphones with an offset acoustic channel. Similar features in these figures include similar numbering. For example, the external case is labeled as 101 in FIG. 1, 201 in FIG. 2, 301 in FIG. 3, and so on. Furthermore, widths, thicknesses, and distances that are present in multiple figures may only be labeled in the figure where they first appear. For example, lateral distance 118 is only labeled in FIG. 1 even though similar lateral distances are present in the examples of FIGS. 2-7.

Figure 2:
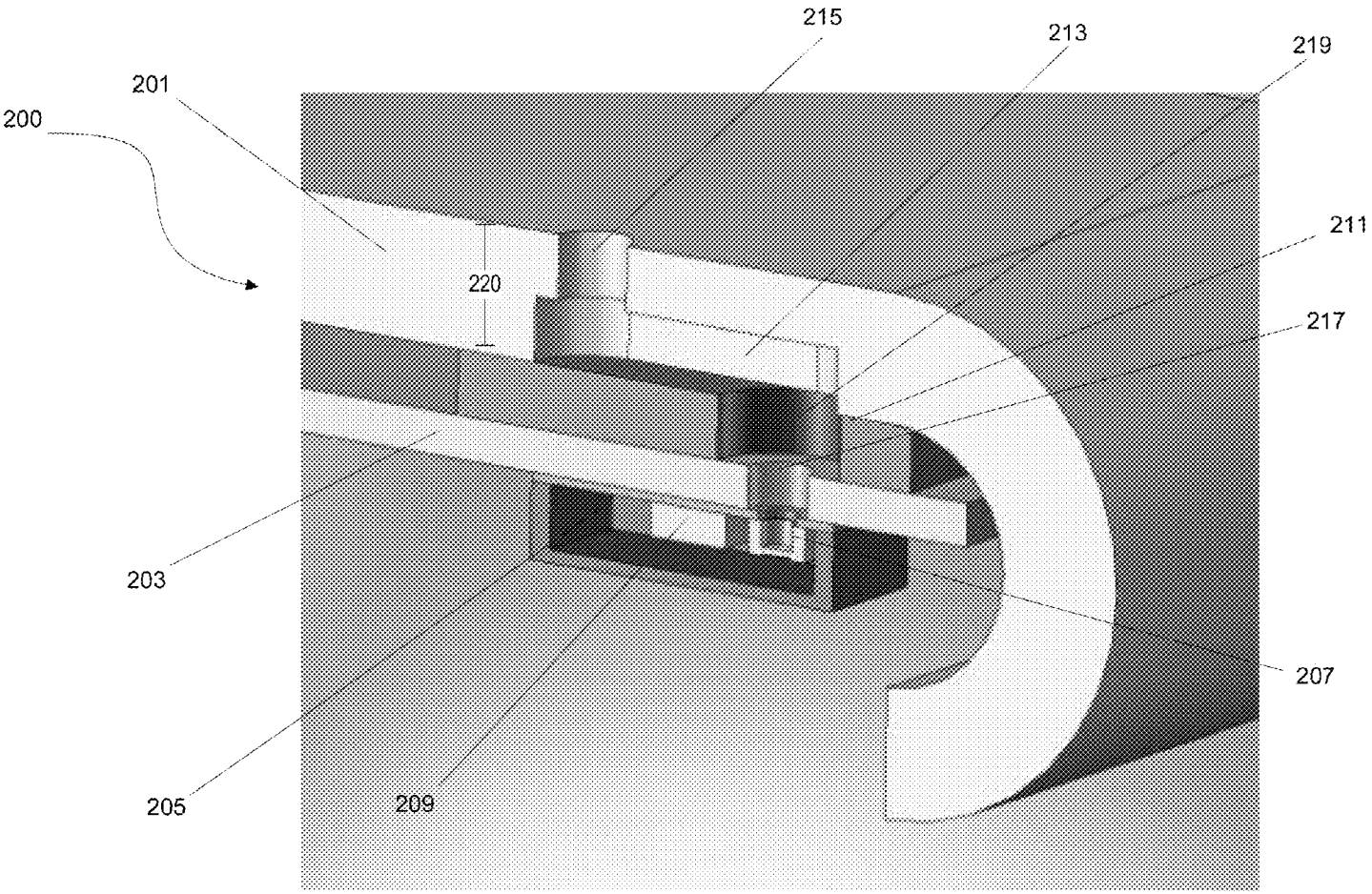
FIG. 2 is a cross-sectional perspective view of a microphone according to another embodiment, where the substrate is positioned between the gasket and the acoustic chamber enclosure, and the acoustic channel is formed in the external case.

FIG. 2 illustrates another example of a microphone 200 including an offset acoustic channel 213. In the example of FIG. 2, the substrate 203 is again positioned between the gasket 211 and the acoustic chamber enclosure 205. Like FIG. 1, the gasket 211 is positioned between the substrate 203 and the external case 201. The microphone transducer 207 and ASIC 209 are mounted on the surface of the substrate 203 inside the acoustic chamber enclosure 205. However, in this example, the acoustic channel 213 that connects the first opening 215 to the second opening 217 is formed in the external case 201. The acoustic channel 213 extends partially through the thickness 220 of the external case 201 and extends across the lateral distance between the first opening 215 and the second opening 217. In order to connect the second opening 217 to the acoustic channel 213, a third opening 219 is formed through the gasket 211 directly above the second opening 217.

Figure 3:
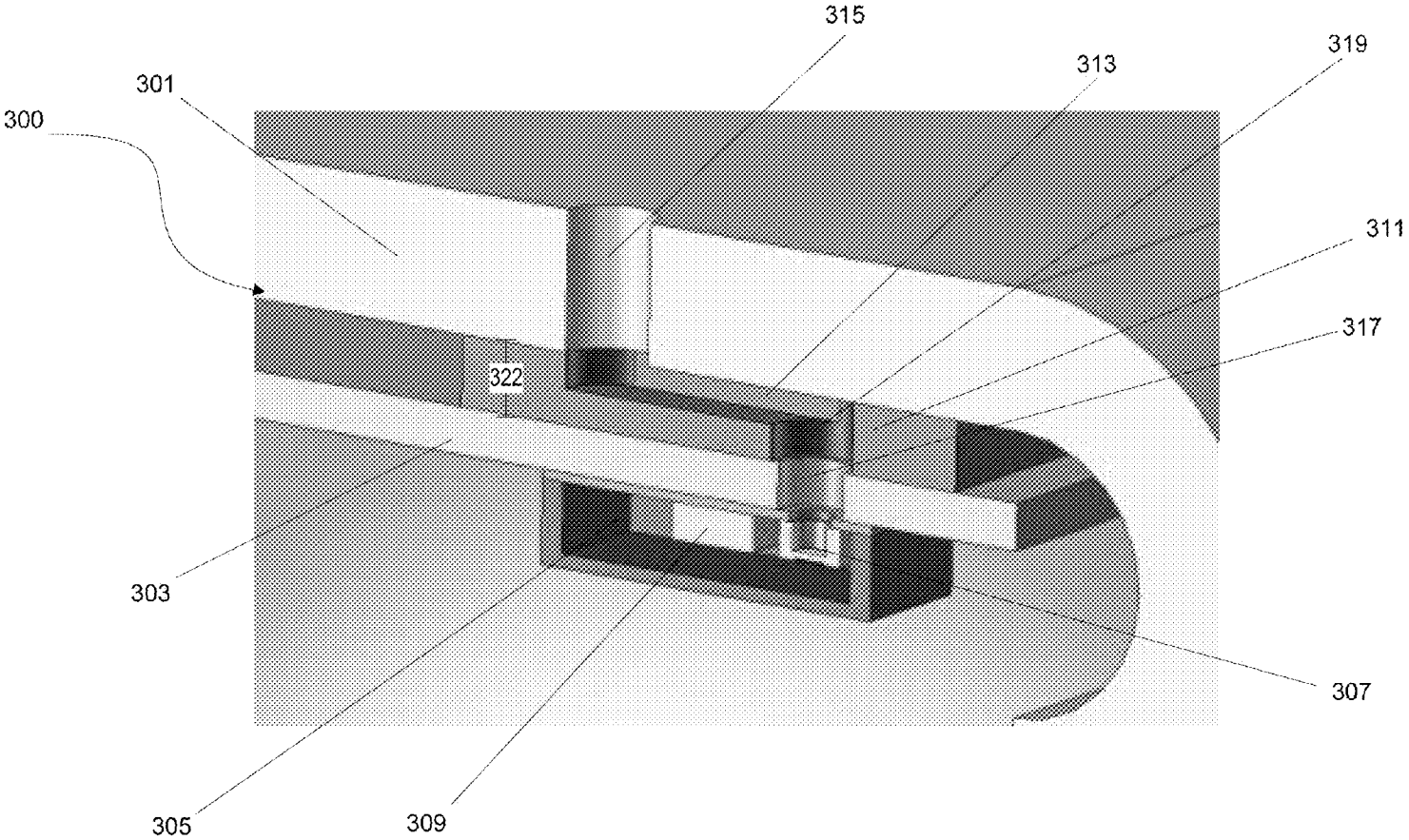
FIG. 3 is a cross-sectional perspective view of a microphone according to another embodiment, where the substrate is positioned between the gasket and the acoustic chamber enclosure, and the acoustic channel is formed across only part of the thickness of the gasket.

FIG. 3 illustrates an example of a microphone 300 where the offset acoustic channel 313 is formed in the gasket 311, but only extends partially through the thickness 322 of the gasket 311. Like the example of FIG. 1, the gasket 311 is positioned between the external case 301 and the substrate 303. The acoustic chamber enclosure 305 is mounted on the substrate 303 on the side opposite the gasket 311. The microphone transducer 307 and the ASIC 309 are mounted on the surface of the substrate 303 inside the acoustic chamber enclosure 305. The acoustic channel 313 again extends along the lateral distance from the first opening 315 in the external case 301 to the second opening 317 in the acoustic chamber enclosure 305. However, in this case, the acoustic channel 313 does not extend through the entire thickness of the gasket 311. Instead, the acoustic channel 313 is thinner than the acoustic channel 113 in FIG. 1 and extends only partially through the thickness of the gasket 311. The acoustic channel 313 is positioned on the side of the gasket 311 adjacent to the external case 301. Like in the example of FIG. 2, a third opening 319 is formed through the entire thickness of the gasket 311 directly above the second opening 317 in the acoustic chamber enclosure 305 to complete the acoustic pathway from the acoustic channel 313 to the acoustic chamber enclosure 305.

Figure 4:
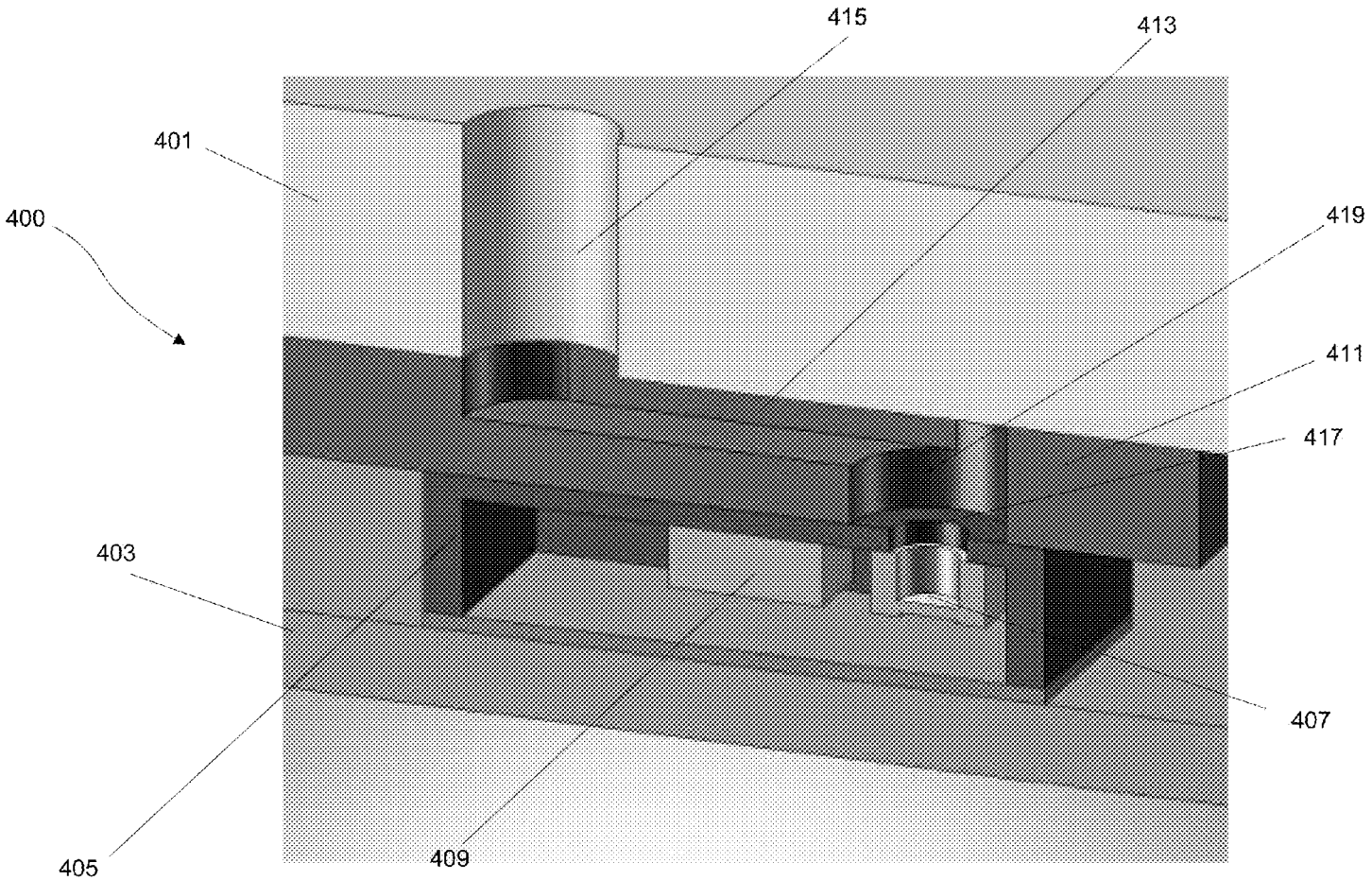
FIG. 4 is a cross-sectional perspective view of a microphone according to another embodiment, where the acoustic chamber enclosure is positioned between the substrate and the gasket, and the acoustic channel is formed across only part of the thickness of the gasket.

FIG. 4 illustrates an example of a microphone 400 that, like the example of FIG. 3, includes an acoustic channel 413 formed partially through the thickness of the gasket 411. However, unlike the above examples, the acoustic chamber enclosure 405 is positioned between the substrate 403 and the gasket 411. In other words, the position of the substrate 403 is moved from between the case 401 and the acoustic chamber enclosure 405 to outside of the acoustic chamber enclosure 405. As such, the gasket 411 is located between the external case 401 and the acoustic chamber enclosure 405. Furthermore, in this example, the microphone transducer 407 and the ASIC 409 are mounted on an interior surface of the acoustic chamber enclosure 405 opposite the substrate 403. The acoustic channel 413 extends across the lateral distance from the first opening 415 in the external case to the second opening 417 in the acoustic chamber enclosure 405. A third opening 419 is formed through the entire thickness of the gasket 411 to complete the acoustic pathway from the acoustic channel 413 to the acoustic chamber enclosure 405.

Figure 5:
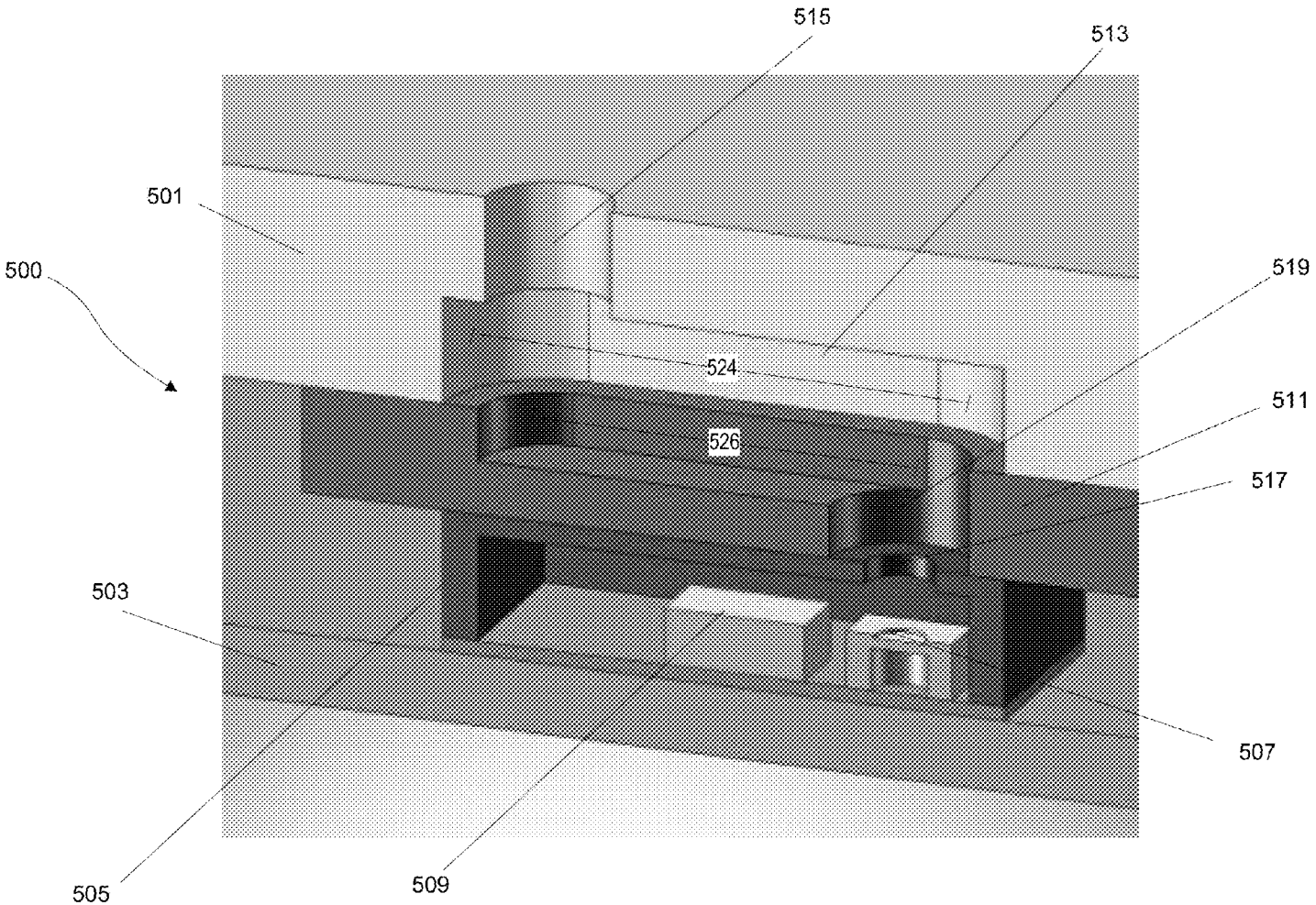
FIG. 5 is a cross-sectional perspective view of a microphone according to another embodiment, where the acoustic chamber enclosure is positioned between the substrate and the gasket, and the acoustic channel is formed across part of the thickness of the gasket and part of the thickness of the external case.

FIG. 5 illustrates yet another example of a microphone 500 that includes an acoustic channel 513 formed partially through the thickness of the gasket 511. However, in this system 500, the acoustic channel 513 also extends partially through the thickness 522 of the external case 501. The gasket 511 is positioned between the external case 501 and the acoustic chamber enclosure 505. The substrate 503 is positioned adjacent to the acoustic chamber enclosure 505 on the side opposite the gasket 511. In this example, the microphone transducer 507 and the ASIC 509 are mounted on the surface of the substrate 503 inside the acoustic chamber enclosure 505 even though the substrate 503 is positioned on the side of the acoustic chamber enclosure 505 opposite the gasket 511. The acoustic channel 513 formed in both the external case 501 and the gasket 511 extends from the first opening 515 to the second opening 517. Again, a third opening 519 is formed in the gasket 511 directly above the second opening 517 to complete the acoustic pathway from the acoustic channel 513 to the acoustic chamber enclosure 505. Furthermore, the portion of the acoustic channel 513 formed in the external case 501 in this example has a larger lateral length 524 than the lateral length 526 of the portion of the acoustic channel 513 formed in the gasket 511. This is, in part, to ensure that the separately manufactured components will line up correctly when installed. In other constructions, the portion of the acoustic channel 513 formed in the gasket 511 will have a larger lateral length than the portion of the acoustic channel 513 formed in the external case 501.

Figure 6:
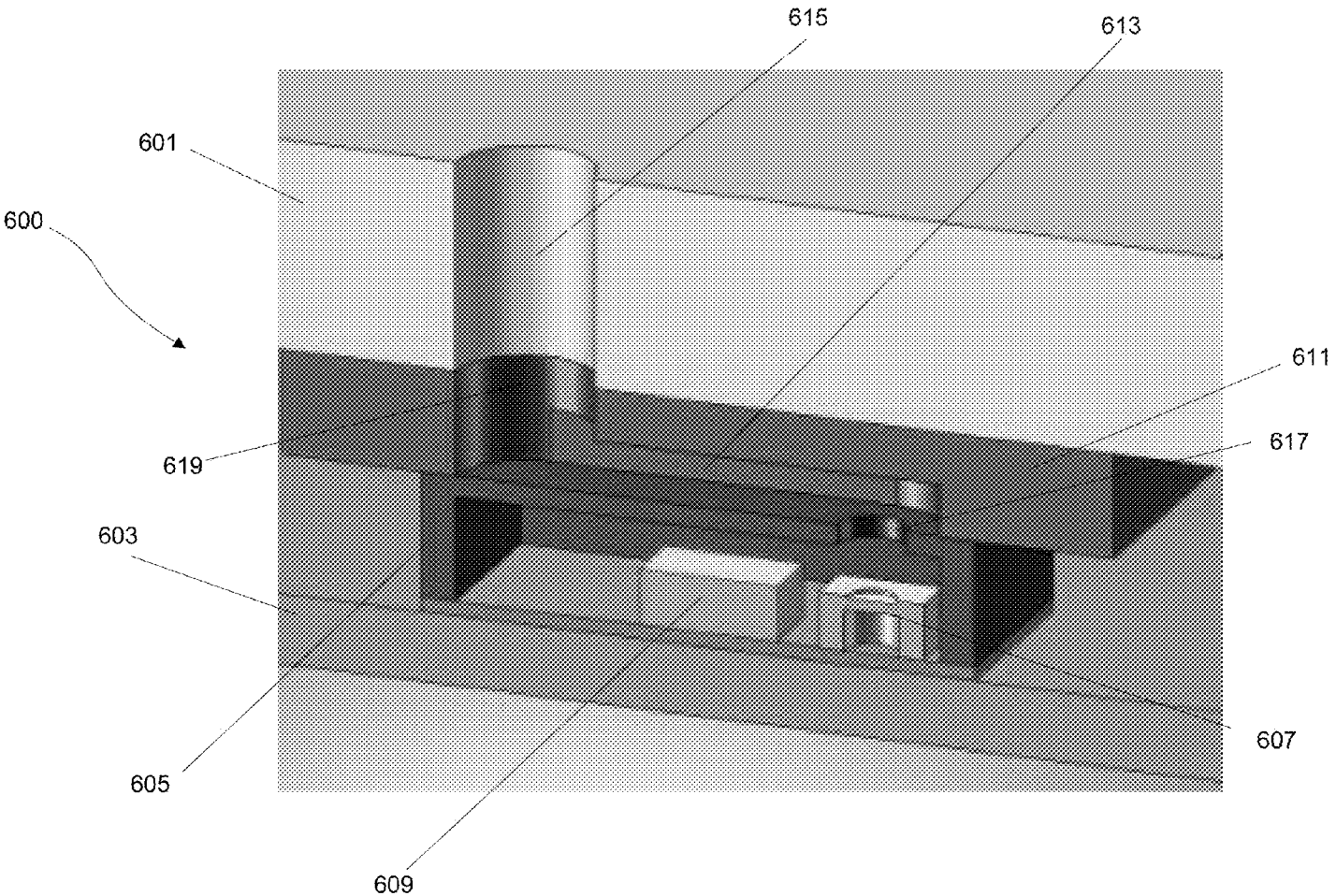
FIG. 6 is a cross-sectional perspective view of a microphone according to another embodiment, where the acoustic chamber enclosure is positioned between the substrate and the gasket, and the acoustic channel is formed across only part of the thickness of the gasket.

FIG. 6 illustrates another example of a microphone 600 that includes an acoustic channel 613 formed partially through the thickness of the gasket 611. However, in this example, the acoustic channel 613 is formed on the surface of the gasket 611 adjacent to the acoustic chamber enclosure 605. Again, the gasket 611 is positioned between the external case 601 and the acoustic chamber enclosure 605. The substrate 603 is positioned adjacent to the acoustic chamber enclosure 605 on the side opposite the gasket 611. The microphone transducer 607 and the ASIC 609 are mounted on the surface of the substrate 603 inside the acoustic chamber enclosure 605. The acoustic channel 613 formed partially through the thickness of the gasket 611 extends across the lateral distance from the first opening 615 to the second opening 617. In this example, the acoustic channel 613 is positioned adjacent to the acoustic chamber enclosure 605. Therefore, the acoustic pathway between the acoustic channel 613 and the acoustic chamber enclosure 605 is already complete. However, a third opening 619 is formed through the entire thickness of the gasket 611 to complete the acoustic pathway from the acoustic channel 613 to the first opening 615 and, thereby, the exterior of the system.

Figure 7:
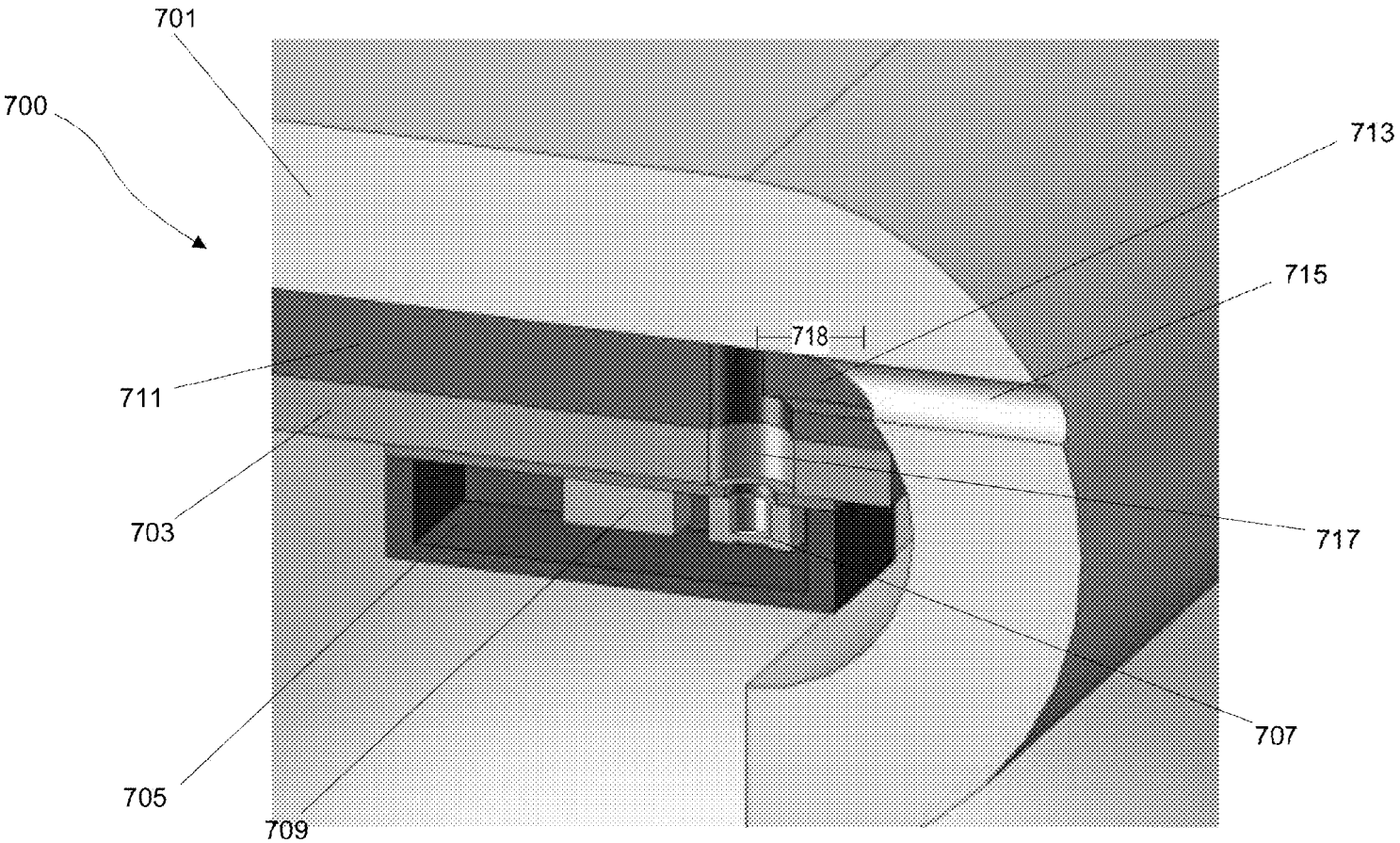
FIG. 7 is a cross-sectional perspective view of a microphone according to another embodiment, where the substrate is positioned between the acoustic chamber enclosure and the gasket, and the opening in the external case is positioned on a surface perpendicular to the opening in the acoustic chamber enclosure.

FIG. 7 illustrates another example of a microphone 700 with an offset acoustic channel 713. However, in this example, the first opening 715 in the external case 701 is formed on a second surface of the external case 701 that is substantially perpendicular to the gasket 711 and the substrate 703. In this example, the gasket 711 is positioned between the external case 701 and the substrate 704. The acoustic chamber enclosure 705 is mounted on the surface of the substrate 703 opposite the gasket 711. The microphone transducer 707 and the ASIC 709 are mounted on the surface of the substrate 703 inside the acoustic chamber enclosure 705. The acoustic channel 713 is again formed in the gasket 711 and extends across the offset lateral distance 718 from the first opening 715 to the second opening 717. However, because the first opening 715 is formed in a surface of the external case 701 that is substantially perpendicular to the gasket 711 and the substrate 703, the first opening 715 is collinear with the acoustic channel 713.

Thus, the invention provides, among other things, microphones that include an offset acoustic channel to prevent direct exposure of a microphone transducer to external elements such as light, wind, and particles. The systems described above are exemplary and can be carried out in other forms and constructions. For example, the microphones of FIGS. 4, 5, and 6 can be modified so that the substrate is positioned between the gasket and the acoustic chamber enclosure. Likewise, the systems of FIGS. 1, 3, 5, 6, and 7 can be modified so that the microphone transducer or the ASIC are mounted on the interior surface of the acoustic chamber enclosure opposite the substrate. Furthermore, some constructions of the invention may not include a substrate. Additionally, in other systems, the acoustic channel can be formed through any portion of the thickness of the gasket and the external case. For example, the system of FIG. 5 can be modified such that the acoustic channel is formed through the entire thickness of the gasket and part of the thickness of the external case. Similarly, the system of FIG. 1 can be modified such that the acoustic channel extends through part of the thickness of the external case and through part of the thickness of the substrate. Various features and advantages of the invention are set forth in the following claims.

What is claimed is:

1. A microphone comprising:

an external case including a first opening;

an acoustic chamber enclosure within the external case, the acoustic chamber enclosure including a second opening positioned an offset lateral distance from the first opening of the external case, a microphone transducer positioned within the acoustic chamber enclosure; and a gasket positioned between the external case and the acoustic chamber enclosure, the gasket including an acoustic channel extending along the offset lateral distance from the first opening of the external case to the second opening of the acoustic chamber enclosure, wherein the external case includes a thickness perpendicular to the offset lateral distance from the first opening of the external case to the second opening of the acoustic chamber enclosure, and wherein a portion of the acoustic channel extends partially into the thickness of the external case along the offset lateral distance from the first opening of the external case to the second opening of the acoustic chamber enclosure and adjacent to the portion of the acoustic channel formed in the gasket.

2. The microphone of claim 1, further comprising a substrate within the external case, wherein the acoustic chamber enclosure is attached to the substrate.

3. The microphone of claim 2, wherein a substrate is positioned between the gasket and the acoustic chamber enclosure, and wherein the second opening from the acoustic chamber enclosure extends through the substrate.

4. The microphone of claim 3, further comprising one or more electronic devices mounted on the substrate, wherein the gasket absorbs vibrations between the external case and the substrate.

5. The microphone of claim 2, wherein the substrate is positioned such that the acoustic chamber enclosure is between the substrate and the gasket.

6. The microphone of claim 5, wherein the gasket absorbs vibrations between the external case and the acoustic chamber enclosure.

7. The microphone of claim 2, wherein the substrate is positioned to form a surface within the acoustic chamber enclosure, and wherein the microphone transducer is mounted on the surface of the substrate within the acoustic chamber enclosure.

8. The microphone of claim 2, wherein the substrate is positioned to form a surface within the acoustic chamber enclosure, and wherein the microphone transducer is mounted on a second internal surface of the acoustic chamber enclosure opposite the substrate surface.

9. The microphone of claim 1, wherein the gasket includes a thickness perpendicular to the offset lateral distance from the first opening of the external case to the second opening of the acoustic chamber enclosure, and wherein the acoustic channel extend through the entire thickness of the gasket.

10. The microphone of claim 1, wherein the gasket includes a thickness perpendicular to the offset lateral distance from the first opening of the external case to the second opening of the acoustic chamber enclosure, and wherein the acoustic channel does not extend through the entire thickness of the gasket.

11. The microphone of claim 10, wherein the acoustic channel extends through a portion of the thickness of the gasket adjacent to the external case, and wherein the gasket further includes a third opening positioned above the second opening of the acoustic chamber enclosure and extending through the thickness of the gasket from the acoustic channel to the second opening of the acoustic chamber enclosure.

12. The microphone of claim 1, wherein the external case includes a first surface parallel to the gasket and a second surface substantially perpendicular to the first surface, and wherein the first opening of the external case is located on the second surface of the external case.

13. A microphone comprising:

an external case including a first opening;

an acoustic chamber enclosure within the external case, the acoustic chamber enclosure including a second opening positioned an offset lateral distance from the first opening of the external case, a microphone transducer positioned within the acoustic chamber enclosure; and a gasket positioned between the external case and the acoustic chamber enclosure, the gasket including an acoustic channel extending along the offset lateral distance from the first opening of the external case to the second opening of the acoustic chamber enclosure, wherein a surface of the acoustic chamber enclosure adjacent to the gasket includes a thickness perpendicular to the offset lateral distance from the first opening of the external case to the second opening of the acoustic chamber enclosure, and wherein a portion of the acoustic channel extends partially into the thickness of the surface of the acoustic chamber enclosure along the offset lateral distance from the first opening of the external case to the second opening of the acoustic chamber enclosure and adjacent to the portion of the acoustic channel formed in the gasket.

14. The microphone of claim 13, wherein the acoustic channel extends through a portion of a thickness of the gasket adjacent to the acoustic chamber enclosure, and wherein the gasket further includes a third opening positioned above the first opening of the external case and extending through the thickness of the gasket from the acoustic channel to the first opening of the external case.

15. A microphone comprising:

an external case including a first opening;

an acoustic chamber enclosure within the external case, the acoustic chamber enclosure including a second opening positioned an offset lateral distance from the first opening of the external case, a microphone transducer positioned within the acoustic chamber enclosure;

a gasket positioned between the external case and the acoustic chamber enclosure, the gasket including an acoustic channel extending along the offset lateral distance from the first opening of the external case to the second opening of the acoustic chamber enclosure; and a substrate positioned within the external case between the gasket and the acoustic chamber enclosure, wherein the acoustic chamber enclosure is mounted on the substrate and the substrate forms a surface within the acoustic chamber enclosure, wherein the substrate includes a thickness perpendicular to the offset lateral distance from the first opening of the external case to the second opening of the acoustic chamber enclosure, and wherein a portion of the acoustic channel extends partially into the thickness of the substrate along the offset lateral distance from the first opening of the external case to the second opening of the acoustic chamber enclosure and adjacent to the portion of the acoustic channel formed in the gasket.

* * * * *